US007459249B2

(12) United States Patent
Suzuki et al.

(10) Patent No.: US 7,459,249 B2
(45) Date of Patent: Dec. 2, 2008

(54) BASE FOR PHOTOSENSITIVE DRUM AND PHOTOSENSITIVE DRUM

(75) Inventors: Takahiro Suzuki, Kodaira (JP); Kunio Machida, Kodaira (JP); Youichi Nishimuro, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 480 days.

(21) Appl. No.: 10/557,710

(22) PCT Filed: May 20, 2004

(86) PCT No.: PCT/JP2004/007204

§ 371 (c)(1),
(2), (4) Date: Nov. 22, 2005

(87) PCT Pub. No.: WO2004/104709

PCT Pub. Date: Dec. 2, 2004

(65) Prior Publication Data

US 2007/0071923 A1 Mar. 29, 2007

(30) Foreign Application Priority Data

May 23, 2003 (JP) ..... 2003-145681

(51) Int. Cl.
*G03G 5/026* (2006.01)

(52) U.S. Cl. ..... 430/56; 430/69

(58) Field of Classification Search ..... 430/56, 430/69

See application file for complete search history.

(56) References Cited

U.S. PATENT DOCUMENTS 5,935,749 A 8/1999 Kawata et al.
6,699,550 B2 3/2004 Suzuki et al.
6,936,389 B2 8/2005 Iizuka et al.
2003/0053821 A1 * 3/2003 Miyakawa et al. ..... 399/159

FOREIGN PATENT DOCUMENTS

| | | | |
|---|---|---|---|
| EP | 1 112 837 | A1 | 7/2001 |
| JP | 04-159560 | A | 6/1992 |
| JP | 7-333876 | A | 12/1995 |
| JP | 8-272118 | A | 10/1996 |
| JP | 10-123735 | A | 5/1998 |
| JP | 11-119456 | A | 4/1999 |
| JP | 2001-34077 | A | 2/2001 |
| JP | 2001-282011 | A | 10/2001 |
| JP | 2002-31909 | A | 1/2002 |
| JP | 2002-311622 | A | 10/2002 |
| JP | 2002-372794 | A | 12/2002 |
| JP | 2002-372795 | A | 12/2002 |
| JP | 2003-5538 | A | 1/2003 |

* cited by examiner

*Primary Examiner*—Hoa V Le
(74) *Attorney, Agent, or Firm*—Sughrue Mion, PLLC

(57) ABSTRACT

A cylindrical base for a photosensitive drum composed of a conductive resin composition containing a resin base material and a conductive material mainly containing carbon black, on which base a solvent-using photosensitive layer is directly formed, is characterized in that the resin base material mainly contains a mixed resin wherein (A) a polyester resin and (B) a polycarbonate resin is blended at a ratio (weight ratio) of (A)/(B)=50/50 to 90/10. The base for a photosensitive drum is excellent in chemical resistance, formability, dimensional accuracy, and adhesion to the photosensitive layer, while being excellent in dimensional stability. A photosensitive drum using such a base exhibits good printing performance and excellent durability.

12 Claims, 1 Drawing Sheet

BASE FOR PHOTOSENSITIVE DRUM AND PHOTOSENSITIVE DRUM

TECHNICAL FIELD

The present invention relates to a photosensitive drum which is suitable for use in electrophotographic apparatuses such as copying machines, facsimiles and printers, and to a base for a photosensitive drum which is suitable for use as a base for forming the photosensitive drum.

BACKGROUND ART

Conventionally, in the electrostatic recording process in copying machines, facsimiles, printers and the like, a printing method has been adopted in which the surface of a photosensitive drum is electrically charged uniformly, an image is projected from an optical system onto the surface of the photosensitive drum to eliminate the electric charges of the light-irradiated areas, thereby forming an electrostatic latent image, then a toner is supplied to the electrostatic latent image to electrostatically adhere the toner to the latent image, thereby forming a toner image, and the toner image is transferred onto a recording medium such as a paper, an OHP sheet, a printing paper, etc.

As a photosensitive drum for use in such an electrostatic recording process, conventionally, one which has the structure shown in FIG. 1 has been generally used.

Specifically, in the photosensitive drum generally used, flanges 2*a*, 2*b* are fittingly fixed to both ends of a cylindrical base 1 having good electrical conductivity, and a photosensitive layer 3 is formed on the outer peripheral surface of the cylindrical base 1. As shown in FIG. 1, ordinarily, the photosensitive drum is rotatably supported in the condition where support shafts 4, 4 provided in a main body a of the electrophotographic apparatus are inserted in shaft holes 5, 5 provided in both the flanges 2*a*, 2*b*, and a gear 7 connected to a drive source such as a motor is meshed with a drive gear 6 formed on the flange 2*b* on one side so that the photosensitive drum can be driven to rotate.

In this case, as a material for forming the cylindrical base 1, aluminum alloys have hitherto been used since they are comparatively light in weight, excellent in machinability, and good in electrical conductivity.

However, in the case of using the cylindrical base formed of an aluminum alloy, in order to meet the requirements for strict dimensional accuracy and for a predetermined surface roughness, high-precision machining must be conducted individually, and both ends of the cylindrical base must be machined for the fitting and fixation of the flanges 2*a*, 2*b* thereto. In some cases, further, a processing may be required for preventing the oxidation of the surface or the like. Therefore, in view of an increased number of manufacturing steps and a raised manufacturing cost, the aluminum alloys are not necessarily satisfactory for use as material for forming the cylindrical base constituting the photosensitive drum.

On the other hand, the formation of a resin-made cylindrical base 1 by use of a conductive resin composition containing a conductive agent such as carbon black mixed and dispersed in a resin base material has also been proposed. For example, Patent Document 1 (Japanese Patent Laid-open No. 2002-372794) discloses a method in which at least one selected from a polyamide resin and a polyester resin is used as a main constituent of a resin base material, and a low-water-absorptivity resin is blended in the resin base material to lower the water absorption of the conductive resin composition to 1.5% or below, whereby a photosensitive drum having a high dimensional stability even under high-temperature high-humidity use conditions can be obtained.

However, in forming a photosensitive layer on a cylindrical base formed of the conductive resin composition containing a polyester resin as a main constituent of the resin base material, the adhesion between the photosensitive layer and the cylindrical base may be insufficient in some cases. In such a case, the surface of the base may be roughened by an after-processing, but such an after-processing may lead to a rise in the manufacturing cost. In addition, since the polyester resin is a crystalline thermoplastic resin, the resin is high in shrinking property, so that there is still a room for improvement as to the dimensional accuracy of the formed product.

The present invention has been made in consideration of the above-mentioned circumstances. Accordingly, it is an object of the present invention to provide a base for a photosensitive drum which is excellent in chemical resistance, formability, dimensional accuracy and adhesion to a photosensitive layer and is excellent in dimensional stability, and a photosensitive drum using the base.

DISCLOSURE OF INVENTION

In order to attain the above object, the present inventor has made intensive and extensive investigations; as a result of the investigations, the present inventor has found out that a cylindrical base for a photosensitive drum composed of a conductive resin composition containing a resin base material and a conductive material mainly containing carbon black, on which base a solvent-using photosensitive layer is directly formed, wherein the resin base material mainly contains a mixed resin in which (A) a polyester resin and (B) a polycarbonate resin are blended in a ratio (weight ratio) of (A)/(B) =50/50 to 90/10, is excellent in chemical resistance, formability, dimensional accuracy, and adhesion to the photosensitive layer, and excellent in dimensional stability, and that the photosensitive drum formed by use of the base has good printing performance and excellent durability. Based on the findings, the present invention has been completed.

Specifically, the present invention provides the base for a photosensitive drum and the photosensitive drum as follows.

[I] A cylindrical base for a photosensitive drum composed of a conductive resin composition containing a resin base material and a conductive material mainly containing carbon black, on which base a solvent-using photosensitive layer is directly formed, wherein the resin base material mainly contains a mixed resin in which (A) a polyester resin and (B) a polycarbonate resin are blended in a ratio (weight ratio) of (A)/(B)=50/50 to 90/10.

[II] The base for a photosensitive drum as defined in the above paragraph [I], wherein the (A) a polyester resin is at least one selected from the group consisting of polyethylene terephthalate, polytrimethylene terephthalate, polybutylene terephthalate, polyethylene naphthalate, and copolymers thereof.

[III] The base for a photosensitive drum as defined in the above paragraph [I] or [II], wherein the surface roughness of the outer peripheral surface of said base has a center line average roughness of not more than 0.8 μm.

[IV] The base for a photosensitive drum as defined in any one of the above paragraphs [I] to [III], wherein the conductive material is blended in an amount of 10 to 40 parts by weight based on 100 parts by weight of the resin base material.

[V] The base for a photosensitive drum as defined in any one of the above paragraphs [I] to [IV], wherein the conductive resin composition contains an inorganic filler as a reinforcing material.

[VI] The base for a photosensitive drum as defined in the above paragraph [V], wherein the inorganic filler is blended in an amount of 15 to 50 parts by weight based on 100 parts by weight of the resin base material.

[VII] A photosensitive drum which a solvent-using photosensitive layer formed directly on the outer peripheral surface of the base for a photosensitive drum as defined in any one of the above paragraphs [I] to [VI].

BEST MODE FOR CARRYING OUT THE INVENTION

Figure 1:
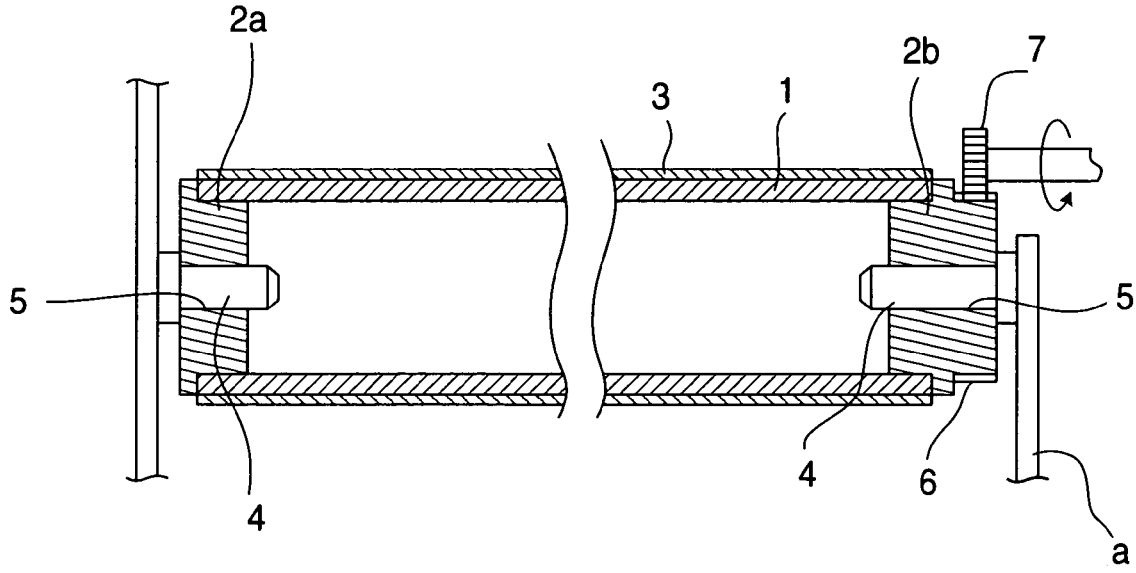
FIG. 1 is a general cross-sectional view showing an example of the photosensitive drum.

Now, the present invention will be described more in detail below.

A cylindrical base for a photosensitive drum according to the present invention is a cylindrical base for a photosensitive drum (hereinafter sometimes referred to simply as the cylindrical base) composed of a conductive resin composition containing a resin base material and a conductive material mainly containing carbon black, on which base a solvent-using photosensitive layer is directly formed, wherein the resin base material mainly (It means that the proportion of a mixed resin based on the resin base material is not less than 50 wt %.) contains a mixed resin in which (A) a polyester resin and (B) a polycarbonate resin are blended in a ratio (weight ratio) of (A)/(B)=50/50 to 90/10.

As the (A) a polyester resin, known ones can be used. Examples of the polyester resins usable include polyethylene terephthalate (PET), polytrimethylene terephthalate (PTT), polybutylene terephthalate (PBT), polyethylene naphthalate (PEN), and copolymers thereof, which are not limitative. These polyester resins can be used either singly or in combination of two or more thereof. Among the examples above, preferred is at least one selected from the group consisting of polyethylene terephthalate, polybutylene terephthalate, and copolymers thereof, from the viewpoints of formability, cost, etc.

Where polybutylene terephthalate is used as the (A) a polyester resin, its intrinsic viscosity is not particularly limited, and is ordinarily in the range of 0.7 to 1.0, preferably 0.75 to 0.95. If the intrinsic viscosity is less than 0.7, impact resistance may not assuredly be obtained; on the other hand, if the intrinsic viscosity exceeds 1.0, formability may be poor.

Besides, where polyethylene terephthalate is used as the (A) a polyester resin, its intrinsic viscosity is not particularly limited, and is ordinarily in the range of 0.7 to 1.0, preferably 0.75 to 0.95. If the intrinsic viscosity is less than 0.7, impact resistance may not assuredly be obtained; on the other hand, if the intrinsic viscosity exceeds 1.0, formability may be poor.

Incidentally, the intrinsic viscosity herein means a value measured at 25° C. using ortho-chlorophenol as a solvent.

The molecular weight of the (B) a polycarbonate resin is not particularly limited, and it, in terms of viscosity average molecular weight, is ordinarily in the range of 15,000 to 25,000, preferably 16,000 to 22,000. If the viscosity average molecular weight is less than 15,000, impact resistance may not assuredly be obtained; on the other hand, if the viscosity average molecular weight exceeds 25,000, formability may be poor.

The blending ratio (weight ratio) of the (A) a polyester resin and the (B) a polycarbonate resin is (A)/(B)=50/50 to 90/10, preferably 60/40 to 80/20. If the blending ratio of the (A) a polyester resin in the mixed resin obtained by blending the (A) resin and the (B) resin is less than 50 wt %, the conductive resin composition according to the present invention is poor in formability, and is low in chemical resistance and low-hygroscopicity property, so that the object of the invention cannot be attained. On the other hand, if the blending ratio exceeds 90 wt %, the base for a photosensitive drum according to the present invention is poor in dimensional accuracy, and satisfactory adhesion cannot be obtained between the base and the photosensitive layer, so that the object of the invention cannot be attained.

In addition, the proportion of the mixed resin obtained by mixing the (A) resin and the (B) resin based on the resin base material in the present invention is not less than 50 wt %, preferably not less than 55 wt %, and more preferably not less than 60 wt %; as for the upper limit, the proportion of the mixed resin is ordinarily not more than 80 wt %, preferably not more than 75 wt %. If the proportion of the mixed resin based on the resin base material is less than 50 wt %, fluidity of the resin composition is worsened, and it becomes difficult to form the base for a photosensitive drum, so that the object of the present invention cannot be attained.

It is preferable to add a compatibilizer to the resin base material, from the viewpoint of enhancing the compatibility between the (A) resin and the (B) resin so as to enhance the impact resistance of the resin base material itself or the conductive resin composition itself, or to enhance the formability of the conductive resin composition. As the compatibilizer, resins having high affinity to both the (A) resin and the (B) resin, and the like are used. Examples of the compatibilizer include epoxidized modified ethylene copolymer, epoxidized modified styrene-butadiene-styrene block copolymer, and maleic acid-modified styrene-butadiene-styrene block copolymer, which are not limitative. The amount of the compatibilizer used can be appropriately set within such a range as not to spoil the object of the present invention. The amount may ordinarily be 2 to 20 wt %, preferably about 5 to 10 wt %, based on the resin base material.

Besides, it is preferable to further blend various additives into the resin base material. For example, it is preferable to blend any of various elastomers such as polyester-based elastomers, olefin-based elastomers and styrene-based elastomers as an impact improver.

In the present invention, the conductive material contained in the conductive resin composition together with the above-mentioned resin base material is preferably a conductive material which can be uniformly dispersed in the resin base material. Examples of the preferable conductive material include carbon black, graphite, powder of metal such as aluminum, copper, nickel, etc., and conductive glass powder, which may be used either singly or in combination of two or more thereof. From the viewpoints of kneadability and low cost, carbon black is used as a main constituent of the conductive material in the present invention. The expression "main constituent" here means that the proportion of carbon black based on the conductive material is not less than 50 wt %. To be more specific, the proportion of carbon black based on the conductive material is ordinarily not less than 50 wt %, preferably not less than 60 wt %, and more preferably not less than 70 wt %; further, a proportion of 100 wt % may also be adopted.

The blending amount of the conductive material is not particularly limited, and is ordinarily not less than 10 parts by weight, preferably not less than 15 parts by weight, with the upper limit being ordinarily not more than 40 parts by weight, preferably not more than 35 parts by weight, based on 100 parts by weight of the above-mentioned resin component. If the amount of the conductive material added to 100 parts by weight of the resin base material is less than 10 parts by weight, the desired conductivity may be unobtainable; on the other hand, if the addition amount exceeds 40 parts by weight, impact resistance and/or formability may be poor.

From the viewpoint of enhancing the strength of the cylindrical base formed, it is preferable to blend an inorganic filler into the conductive resin composition according to the present invention. Examples of the inorganic filler which can be used include conductive fibers such as carbon fibers, conductive whiskers, conductive glass fibers, etc., and nonconductive fibers such as whiskers, glass fibers, etc. In this case, the conductive fibers can act also as the conductive material, so that the amount of the conductive material used can be reduced by using the conductive fibers as the inorganic filler. Besides, the shape of the inorganic filler is not particularly limited; a microspherical substance and/or a flaky substance can be used. By the addition of such a filler, the strength and rigidity of the formed product can be effectively enhanced, without lowering the surface smoothness.

The blending amount of the inorganic filler is appropriately selected according to the kind of the filler used, the length and diameter of the fibers of the filler, and the like, and is not particularly limited. The blending amount is ordinarily not less than 15 parts by weight, preferably not less than 20 parts by weight, the upper limiting being ordinarily not more than 50 parts by weight, preferably not more than 45 parts by weight, based on 100 parts by weight of the resin base material. If the amount of the inorganic filler added to 100 parts by weight of the resin base material is less than 15 parts by weight, mechanical strength may be poor; on the other hand, if the amount exceeds 50 parts by weight, formability may be poor.

Incidentally, in addition to the conductive material and the inorganic filler, the conductive resin composition in the present invention, if necessary, may be admixed with other known additives such as polytetrafluoroethylene (PTFE), silicone, molybdenum disulfide ($MoS_2$), various metallic soaps, etc. Besides, the conductive material and/or the inorganic filler may be surface treated by use of a silane coupling agent, a titanate coupling agent or the like being in ordinary use.

The base for a photosensitive drum according to the present invention is a cylindrical base formed of the conductive resin composition constituted of the above-mentioned components, on which base a solvent-using photosensitive layer is directly formed. The method for forming the conductive resin composition into the cylindrical base is not particularly limited, and known methods such as the injection molding method and the extrusion molding method can be adopted, among which the injection molding method is normally preferred. In this case, the molding conditions such as molding temperature and injection pressure can be set ordinary conditions according to the materials used and the like.

The surface resistance of the cylindrical base is not particularly limited, and is preferably not more than $10^6$ Ω/□ (ohms/square), more preferably not less than $10^5$ Ω/□, further preferably not less than $10^4$ Ω/□.

The base for a photosensitive drum according to the present invention, like the cylindrical base 1 shown in FIG. 1, is ordinarily equipped with flanges 2*a*, 2*b* which are formed separately from the base and fittingly fixed to both end faces of the base; however, at least one of the flanges 2*a*, 2*b* may be formed as one body with the base (cylindrical base 1) for a photosensitive drum. Besides, since a molded product excellent in strength and rigidity can be obtained by adding the above-mentioned reinforcing inorganic filler, a drive gear 6 can also be integrally formed together with the flange.

The surface roughness of the outer peripheral surface of said base for a photosensitive drum according to the present invention is not particularly limited, and it, in terms of center line average roughness Ra, is ordinarily not more than 0.8 μm, preferably not more than 0.2 μm, and, in terms of maximum height Rmax, is ordinarily not more than 1.6 μm, preferably not more than 0.8 μm. In addition, the surface roughness, in terms of 10 point average roughness Rz, is ordinarily not more than 1.6 μm, preferably not more than 0.8 μm. If the values of these Ra, Rmax and Rz are too great, the concavity and convexity in the surface of the cylindrical base 1 is transferred on the photosensitive layer 3, causing defects in the image printed by use of the photosensitive drum.

As shown in FIG. 1, the photosensitive drum according to the present invention has a solvent-using photosensitive layer formed directly on the outer peripheral surface of a base for a photosensitive drum according to the present invention which corresponds to the cylindrical base 1. Here, the "solvent-using photosensitive layer" means a photosensitive layer obtained by dissolving a photosensitive agent and a binder component in a solvent such as alcohol, chloroform, toluene, etc. to prepare a photosensitive layer solution, applying the photosensitive layer solution to a base material, and evaporating off the solvent. Since the base for a photosensitive drum of the present invention is formed by use of the resin base material mainly containing the mixed resin having the specified composition as above-described, the base is excellent in chemical resistance, so that any problems (e.g., dissolution, deformation or swelling of the base) are not generated at the time of forming the photosensitive layer by use of the photosensitive layer solution, and "the solvent-using photosensitive layer" thus formed shows good adhesion to the base for the photosensitive drum.

In addition, since the base for a photosensitive drum of the present invention is excellent in formability, dimensional accuracy and dimensional stability, it is excellent in coatability for coating with the coating liquid at the time of forming the solvent-using photosensitive layer, so that a defect-free photosensitive layer can be formed assuredly. The photosensitive drum of the present invention produced in this manner has excellent printing performance, in cooperation with the good dimensional accuracy and dimensional stability, and is excellent in durability derived from good adhesiveness to the photosensitive layer; thus, an excellent photosensitive drum is realized.

Incidentally, as the solvent for forming the photosensitive layer, known solvents can be used. As the photosensitive agent and the binder component, also, known ones can be used. Furthermore, additives may be blended into the photosensitive layer solution.

The photosensitive drum according to the present invention is not limited to the one shown in FIG. 1. For example, the flanges 2*a*, 2*b* may be provided not with the shaft holes 5 but with shaft bodies (support shaft) projecting outwards, and the drum may be rotatably mounted to the main body of the electrophotographic apparatus by use of the shaft bodies. Further, the shape of the flanges 2*a*, 2*b*, the method of rotationally driving the photosensitive drum, and other configurations can also be appropriately modified within the scope of the gist of the present invention.

The base for a photosensitive drum according to the present invention is excellent in chemical resistance, formability, dimensional accuracy, and adhesion to the photosensitive layer, and is excellent in dimensional stability. The photosensitive drum using the base is a photosensitive drum having good printing performance and excellent durability.

EXAMPLES

Now, the present invention will be described more detail below by way of Examples and Comparative Examples, but it should be understood that the present invention is not limited to or by the following Examples.

Examples 1 to 4

Comparative Examples 1, 2

The mixtures blended in ratio shown in Table 1 were individually melted and kneaded by a twin-screw extruder with a diameter of 31 mm and a barrel temperature set to 250° C., to prepare conductive resin compositions. By use of an injection molding machine with a cylinder temperature set to 260° C. and a mold temperature to 110° C., each of the conductive resin compositions was molded into a cylindrical base for a photosensitive drum having an outside diameter of 30 mm, a length of 260 mm, and a peripheral wall thickness of 1.5 mm.

Each base for a photosensitive drum thus obtained was annealed at 140° C. for 2 hours, was cooled down to normal temperature, and was subjected to measurement of dimensional accuracy and moisture absorption.

Next, each base for a photosensitive drum was coated with the following photosensitive layer forming coating liquid by a dip coating method, followed by drying by heating at 130° C. for 60 minutes to form a photosensitive layer, thereby obtaining a photosensitive drum.

Photosensitive Layer Forming Coating Liquid

| | |
|---|---|
| Electric charge generating material: Phthalocyanine | 5 parts by weight |
| Electric charge transport material: Diphenylhydrazine | 60 parts by weight |
| Binder resin: Polycarbonate | 100 parts by weight |
| Solvent: Tetrahydrofuran | 600 parts by weight |

Each photosensitive drum obtained above was subjected to measurement of adhesion to the photosensitive layer. The results are also shown in Table 1.

PBT

Polybutylene terephthalate; PBT120 (intrinsic viscosity: 0.86), produced by Kanebo Gohsen Ltd.

PET

Polybutylene terephthalate; TR-8580 (intrinsic viscosity: 0.8), produced by Teijin Ltd.

PC

Polycarbonate; TARFLON A1700 (viscosity average molecular weight: 17000), produced by Idemitsu Petrochemical., Ltd.

Stabilizer

Organic phosphite compound; ADEKASTAB AX-71, produced by Asahi Denka Co., Ltd.

C/B

Carbon black; AX-015, produced by Asahi Carbon Co., Ltd.

Reinforcing Agent (Inorganic Filler)

Wollastonite; PH330S, produced by Kawatetsu Kogyo Co., Ltd.

Dimensional Accuracy (Fluctuation of Rotation (μm))

Rotation was effected at 180 rpm by use of Laser Scan Micro (rotation fluctuation measuring apparatus), and an averaging treatment was conducted 256 times per second, so as to thereby measure the fluctuation of rotation of a central portion of the base for a photosensitive drum.

Adhesion (The Number of Exfoliated Squares)

According to JIS K 5400, 25-square cross cuts were formed at an interval of 2 mm, and the adhesion of the photosensitive layer was measured by the cross cut tape method.

Moisture Absorption (Change Rate of Outside Diameter (%))

The base for a photosensitive drum was left to stand in a high-temperature high-humidity condition of 50° C. and 90% RH, and the change rate of outside diameter, caused by the leaving to stand, was measured. The measurement was used as an index of dimensional stability.

The results shown in Table 1 show the following. The cylindrical base of the present invention formed by use of the resin base material mainly containing the mixed resin having a specified composition is excellent in adhesion to the photosensitive layer, excellent in dimensional accuracy, and is low in hygroscopicity (moisture absorption). Therefore, the photosensitive drum using the base according to the present invention also has good dimensional accuracy and low moisture absorption.

TABLE 1

| | Composition ratio (parts by weight) | | | | | | Dimensional accuracy Fluctuation | Adhesion Number of | Moisture absorption Change rate |
|---|---|---|---|---|---|---|---|---|---|
| | PBT | PET | PC | Stabilizer | C/B | Reinforcing agent | of rotation (μm) | exfoliated squares | of outside diameter (%) |
| Example 1 | 60 | | 40 | 0.1 | 22 | 35 | 8 | 0 | 0.18 |
| Example 2 | 75 | | 25 | 0.1 | 22 | 35 | 10 | 0 | 0.12 |
| Example 3 | 80 | | 20 | 0.1 | 22 | 35 | 12 | 0 | 0.10 |
| Example 4 | 40 | 30 | 30 | 0.1 | 22 | 35 | 11 | 0 | 0.12 |
| Comparative Example 1 | 100 | | | | 22 | 35 | 40 | 25 | 0.08 |
| Comparative Example 2 | 30 | | 70 | 0.1 | 22 | 35 | 7 | 0 | 0.25 |

The invention claimed is:

1. A cylindrical base for a photosensitive drum composed of a conductive resin composition containing a resin base material and a conductive material mainly containing carbon black, on which base a solvent-using photosensitive layer is directly formed, wherein said resin base material mainly contains a mixed resin in which (A) a polyester resin and (B) a polycarbonate resin are blended in a ratio (weight ratio) of (A)/(B)=50/50 to 90/10.

2. The base for a photosensitive drum as defined in claim 1, wherein the (A) a polyester resin is at least one selected from the group consisting of polyethylene terephthalate, polytrimethylene terephthalate, polybutylene terephthalate, polyethylene naphthalate, and copolymers thereof.

3. The base for a photosensitive drum as defined in claim 1, wherein the surface roughness of the outer peripheral surface of said base has a center line average roughness of not more than 0.8 μm.

4. The base for a photosensitive drum as defined in claim 1, wherein said conductive material is blended in an amount of 10 to 40 parts by weight based on 100 parts by weight of said resin base material.

5. The base for a photosensitive drum as defined in claim 1, wherein said conductive resin composition contains an inorganic filler as a reinforcing material.

6. The base for a photosensitive drum as defined in claim 5, wherein said inorganic filler is blended in an amount of 15 to 50 parts by weight based on 100 parts by weight of said resin base material.

7. A photosensitive drum in which a solvent-using photosensitive layer is formed directly on the outer peripheral surface of the base for a photosensitive drum as defined in claim 1.

8. A photosensitive drum in which a solvent-using photosensitive layer is formed directly on the outer peripheral surface of the base for a photosensitive drum as defined in claim 2.

9. A photosensitive drum in which a solvent-using photosensitive layer is formed directly on the outer peripheral surface of the base for a photosensitive drum as defined in claim 3.

10. A photosensitive drum in which a solvent-using photosensitive layer is formed directly on the outer peripheral surface of the base for a photosensitive drum as defined in claim 4.

11. A photosensitive drum in which a solvent-using photosensitive layer is formed directly on the outer peripheral surface of the base for a photosensitive drum as defined in claim 5.

12. A photosensitive drum in which a solvent-using photosensitive layer is formed directly on the outer peripheral surface of the base for a photosensitive drum as defined in claim 6.

* * * * *